US008853963B2

(12) United States Patent
Liscinsky et al.

(10) Patent No.: US 8,853,963 B2
(45) Date of Patent: Oct. 7, 2014

(54) LOW CURRENT SOLUTION FOR ILLUMINATED SWITCHES USING DC OPERATED LEDS

(75) Inventors: Stephen M. Liscinsky, Stratford, CT (US); Gregg R. Schelmetic, Fairfield, CT (US)

(73) Assignee: Hubbell Incorporated, Shelton, CT (US)

( * ) Notice: Subject to any disclaimer, the term of this patent is extended or adjusted under 35 U.S.C. 154(b) by 219 days.

(21) Appl. No.: 13/599,702

(22) Filed: Aug. 30, 2012

(65) Prior Publication Data

US 2013/0057171 A1 Mar. 7, 2013

Related U.S. Application Data

(60) Provisional application No. 61/573,111, filed on Sep. 2, 2011.

(51) Int. Cl.

| | |
|---|---|
| ***G05F 1/00*** | (2006.01) |
| ***H05B 37/02*** | (2006.01) |
| ***H05B 33/08*** | (2006.01) |

(52) U.S. Cl.

CPC ..... *H05B 33/083* (2013.01); *H05B 33/0809* (2013.01)

USPC ..... 315/291; 307/139; 315/361; 315/209 R; 200/310

(58) Field of Classification Search

USPC ..... 315/291, 361, 209 R; 307/139; 200/310

See application file for complete search history.

(56) References Cited

U.S. PATENT DOCUMENTS

| | | | | |
|---|---|---|---|---|
| 5,903,107 | A | 5/1999 | Wade | |
| 7,506,990 | B2 | 3/2009 | Glazner | |
| 7,850,322 | B2 | 12/2010 | Glazner et al. | |
| 8,564,219 | B2 * | 10/2013 | Lee et al. | 315/291 |
| 8,587,223 | B2 * | 11/2013 | Ilyes et al. | 315/308 |
| 2010/0288609 | A1 | 11/2010 | Strothmann | |

* cited by examiner

*Primary Examiner* — Douglas W Owens
*Assistant Examiner* — Syed M Kaiser
(74) *Attorney, Agent, or Firm* — Christian C. Michel; Mark S. Bicks; Alfred N. Goodman

(57) ABSTRACT

A switch circuit utilizes an LED for illumination. A diode is connected in parallel with the LED but in opposite orientation, with the LED anode connected to the diode cathode, and the LED cathode connected to the diode anode, to permit discharging of a power supply capacitor of a ballast of a lamp such as a compact fluorescent light (CFL) bulb. Undesirable flickering of the CFL are then avoided.

17 Claims, 4 Drawing Sheets

DC LED Circuits

LOW CURRENT SOLUTION FOR ILLUMINATED SWITCHES USING DC OPERATED LEDS

FIELD OF THE INVENTION

The present invention relates to illuminated switches. More particularly, the present invention relates to improved circuits for use with illuminated light switches using an LED as a light source.

BACKGROUND OF THE INVENTION

The majority of modern compact fluorescent lamps and fluorescent lamp ballasts operate with a common design principle. The typical design converts the incoming AC line power to a high DC voltage and then in turn, converts the DC voltage into a high frequency, high voltage square wave to drive connected fluorescent lamps. A typical compact fluorescent lamp ballast is described in U.S. Pat. No. 7,202,614, which is hereby incorporated by reference in its entirety.

As a result of this high frequency, high voltage square wave used to drive the fluorescent lamps, the circuit tends to create significant electrical interference that can come back across the AC power line, as well as be radiated into the air. This interference can cause problems with other electrical apparatus in the area. To minimize the effect of this interference, a filter, typically comprising an inductor and capacitor such as is shown in FIG. 6, is commonly employed to shunt the interference to ground.

Illuminated switches are designed to generate a small light so as to be as visible in a dark area. The typical illumination uses a neon lamp as shown in FIG. 5. One of the disadvantages of this type of circuit is that the neon lamp has limited life span, and after a few years the neon may not be bright enough, or may even fail to illuminate.

To solve this problem an LED may be used in place of the neon lamp. A properly chosen LED and associated circuitry will last many times longer than a neon lamp. Both LEDs and neon lamps operate on a similar principle of leaking a small amount of current through the connected load when the light switch is in the off position. However, where neon lamps typically operate on an AC voltage in this type of application, LEDs operate on a DC voltage. That is, by their nature, LEDs illuminate when current flows in one direction and prevent current from flowing in the opposite direction.

A conventional LED circuit for this application is shown in FIG. 1. A variety of circuits will illuminate the LED and allow the associated load, whether it is a fluorescent lamp, ballast or incandescent bulb to operate properly. Due to the nature of the LED, care has to be taken to use a proper circuit design for the illuminated switch to avoid problems not present in neon bulb circuits.

For example, if the LED circuit shown in FIG. 1 is used for the illuminated switch, flickering of the connected fluorescent lamps may occur. This flickering happens because DC is used to illuminate the LED, and that current continues to flow into the electronic ballast power supply capacitor (C2). When there is sufficient charge on capacitor C2, the drive circuit engages and fires the connected lamp(s). The capacitor then discharges and the cycle repeats, continuously, causing a disadvantageous flickering of the lamp.

When an illuminated switch employing a neon lamp as an indicator is used in this application, the flickering lamp problem will not occur, because a neon lamp operates on AC. That is, the neon lamp permits current to flow in both directions. The alternating current used to illuminate the neon lamp leaks through the electronic ballast circuitry as does the DC current for the LED, however the majority of the alternating current used for the neon lamp leaks through the capacitor (C1) used for the interference filter, such that capacitor C2 is not charged enough to engage the drive circuit for the lamp.

This insufficient charging is because an alternating current will pass through a capacitor, while a direct current charges the capacitor. Thus, there is not enough current available to charge the power supply capacitor in the electronic ballast circuit because the majority of the current is shunted by the interference capacitor (C1) before it can enter the power supply circuit of the ballast.

Accordingly, a need exists for an improved circuit for an LED for use in an illuminated light switch. That circuit will avoid disadvantages of conventional designs, including minimizing or avoiding flickering associated with the use of LEDs in conventional illuminated switch circuits.

BRIEF DESCRIPTION OF THE DRAWING FIGURES

These and other features and advantages of the present invention will become more apparent from the detailed description of exemplary embodiments with reference to the attached drawings in which.

Throughout the drawings, like reference numerals will be understood to refer to like features and structures.

DETAILED DESCRIPTION OF EXEMPLARY EMBODIMENTS

Figures 1, 2, 3, 4, 5:
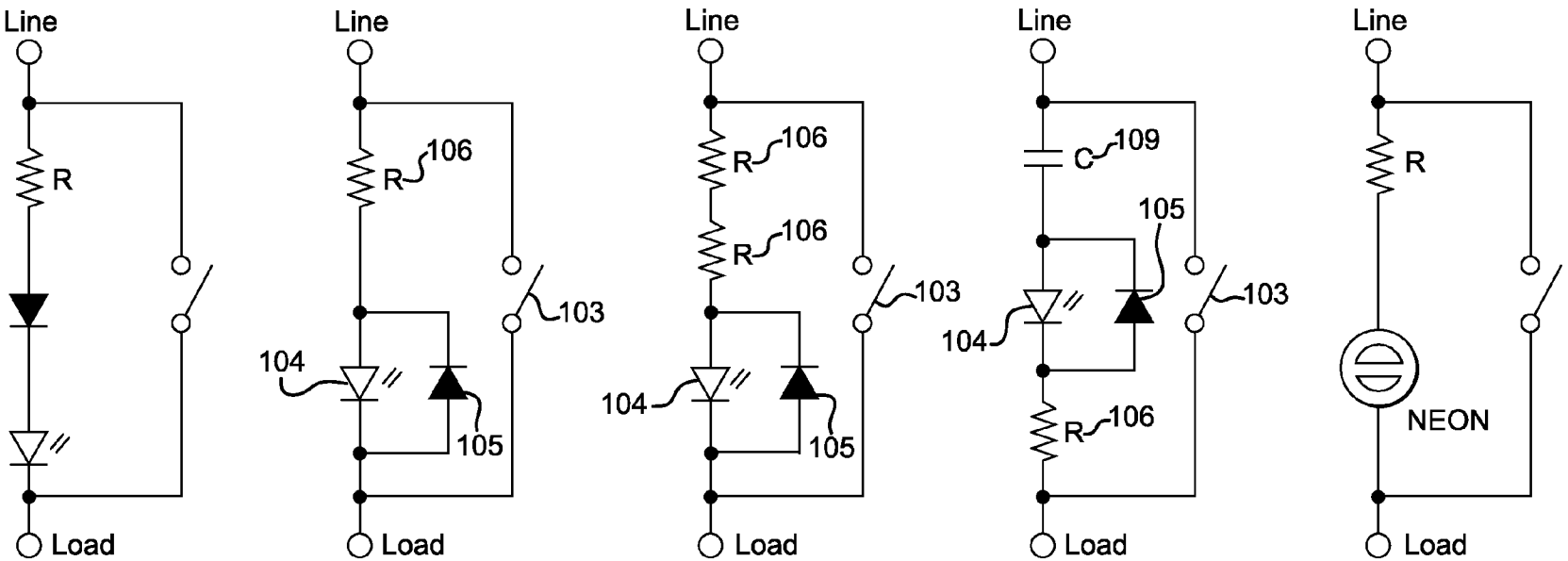
FIG. 1 PRIOR ART
FIG. 5 PRIOR ART
FIG. 1 is a circuit diagram of a conventional illuminated switch circuit utilizing an LED for illumination.
FIG. 2 is a circuit diagram of an exemplary embodiment of an illuminated switch circuit according to a first embodiment of the present invention.
FIG. 3 is a circuit diagram of an exemplary embodiment of an illuminated switch circuit according to a second embodiment of the present invention.
FIG. 4 is a circuit diagram of an exemplary embodiment of an illuminated switch circuit according to a third embodiment of the present invention.
FIG. 5 is a circuit diagram of a conventional illuminated switch circuit utilizing a neon lamp for illumination.

Embodiments of the present invention utilize circuits such as those illustrated in FIGS. 2-4 for a low power DC illuminated switch using an LED 104. Of course the circuits illustrated in FIGS. 2-4 are merely exemplary and other similar types of circuits may be employed. These circuits advantageously clamp the voltage across the LED 104 so current will flow through the LED in one direction. Current will continue to flow through the electronic ballast circuit, including the capacitor 109 used to minimize interference, by flowing in the opposite direction through a diode 105 connected in parallel with the LED 104. Preferably, the values of the current limiting resistors 106, capacitors 109, or both, are carefully selected so that a minimal amount of current will flow through the electronic ballast circuit to avoid flickering of the connected fluorescent lamps. Embodiments of the present invention are advantageous for use with any lighting device requiring a ballast, but are particularly useful in connection with compact fluorescent light (CFL) bulbs which typically include a built-in ballast.

Figure 6:
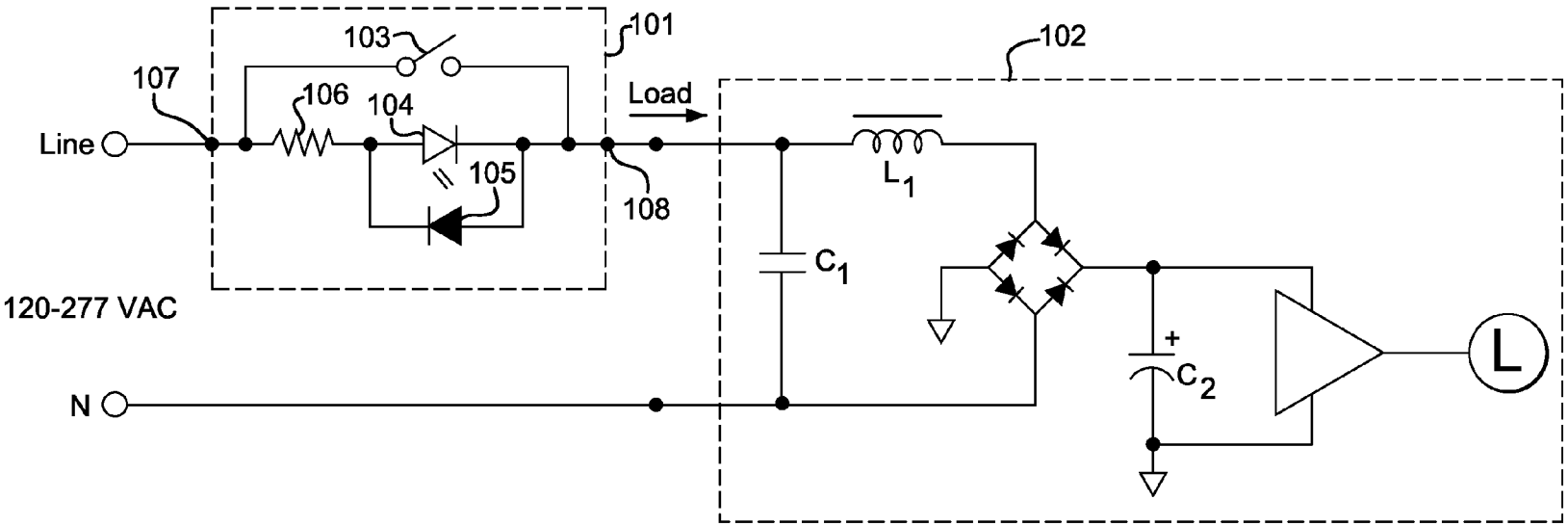
FIG. 6 is a circuit diagram of an illuminated switch circuit, ballast and lamp according to a fourth exemplary embodiment of the present invention.

Referring to FIG. 6, an exemplary embodiment of the present invention will now be described in operation. Illuminated switch circuit 101 is connected to ballast and lamp circuit 102. The switch circuit 101 and ballast and lamp circuit 102 are connected to a source of AC power, such as 120 VAC power, as shown. When the switch 103 is closed, the LED 104 is short circuited such that the LED remains turned off. When the switch 103 is opened, current flows through the LED during the positive half-wave of the AC cycle, and flows through the diode 105 during the negative half-wave. The illuminated switch circuit 101 also includes a current limiting resistor 106 to limit the current through the illuminated switch circuit 101 when the switch 103 is open. The LED 104 is connected in parallel with the diode 105, and as can be seen, the LED 104 and diode 105 are connected in opposite polarity, such that the anode of the LED 104 is connected to the cathode of the diode 105. Accordingly, current can flow in one direction through the LED 104, and in the opposite direction through the diode 105.

The switch circuit 101 preferably includes a first terminal 107 to be connected to a source of AC power, and typically to the hot conductor of a building's electrical wiring. The switch circuit 101 also preferably includes a second terminal 108 to be connected to the ballast and lamp circuit 102. Accordingly, the switch circuit 101 can easily be installed into a building at a light switch fixture, for example, to operate a lighting device connected to the switch.

As will be appreciated by those of ordinary skill in the art, the embodiment depicted in FIG. 2 is shown utilized in the embodiment of FIG. 6, and the alternate embodiments of illuminated switch circuits depicted in FIGS. 3 and 4 may be substituted for the illuminated switch circuit depicted in FIG. 6. For example, FIG. 3 illustrates an embodiment that uses two current limiting resistors 106 in series with the combination with and between a line connection and LED 104 at diode 105. FIG. 4 illustrates a capacitor 109 connected in series with the combination of the LED 104 and diode 105, as well as the current limiting resistor 106 with the capacitor between the line connection and LED 104 at diode 105. [ADD EXPLANATION OF EMBODIMENTS] Furthermore, those of ordinary skill in the art will readily appreciate that many other changes and modifications may be made and substituted as alternative illuminated switch circuits.

Figure 7:
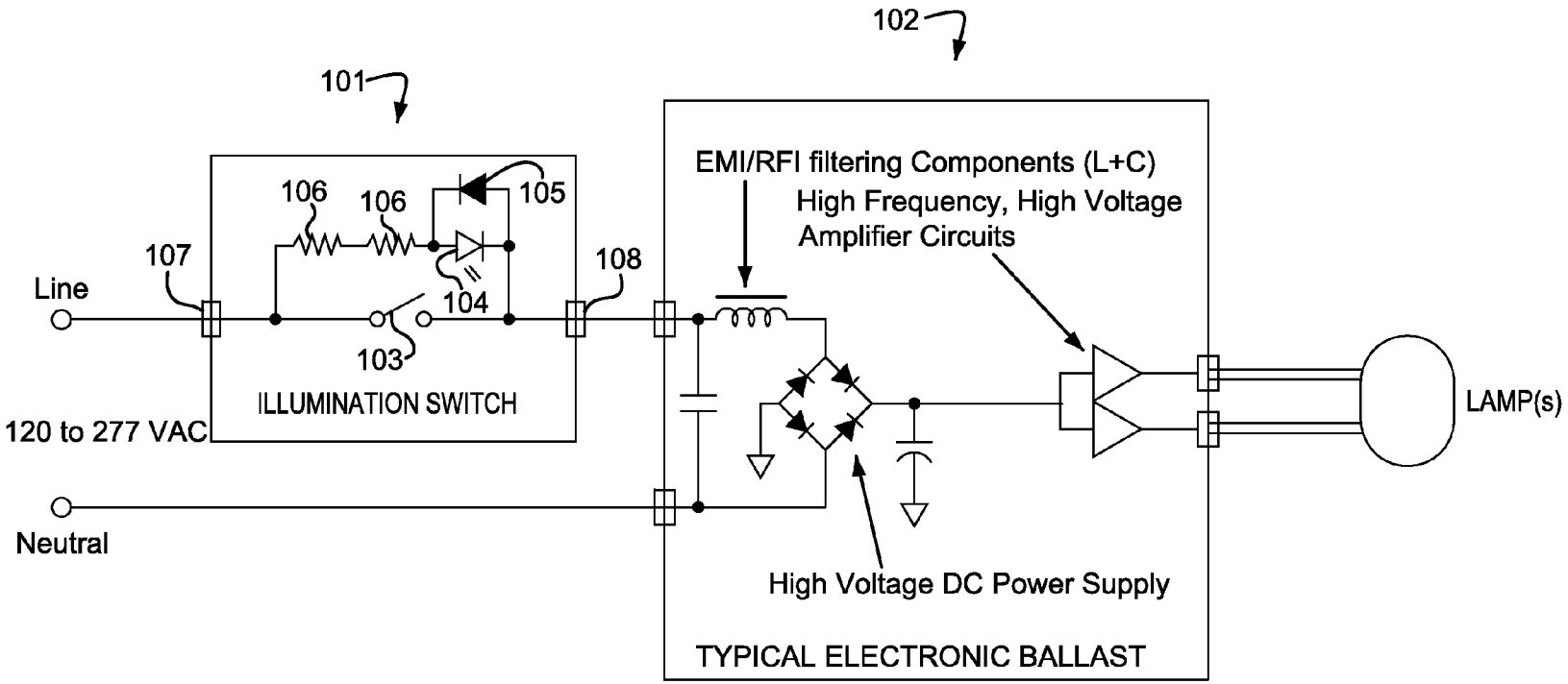
FIG. 7 is a circuit diagram of an illuminated switch circuit, ballast and lamp according to a fifth exemplary embodiment of the present invention.

FIG. 7 depicts another exemplary embodiment of the present invention, employing the exemplary illuminated switch circuit of FIG. 3. The illuminated switch circuit 701 of FIG. 7 utilizes two resistors in series with an LED connected in parallel with a diode. The two resistors act as a voltage divider, permitting lower rated resistors to be used.

If a single resistor is used in the illuminated switch circuit, the preferred value is 320 kΩ If two resistors are used, then each is preferably 160 kΩ and sized for approximately 0.5 W. If a capacitor is used in place of a resistor in the illuminated switch circuit, the value is preferably 0.0082 μF (Xc at 60 Hz=324 k). The diode uses is preferably a 1N4007 (1000V, 1 A rectifier). The LED is preferably of a high brightness type.

The embodiment depicted in FIG. 4 utilizes a capacitor with appropriately selected impedance in series with the combination LED and diode, and further in series with a resistor.

Figure 8:
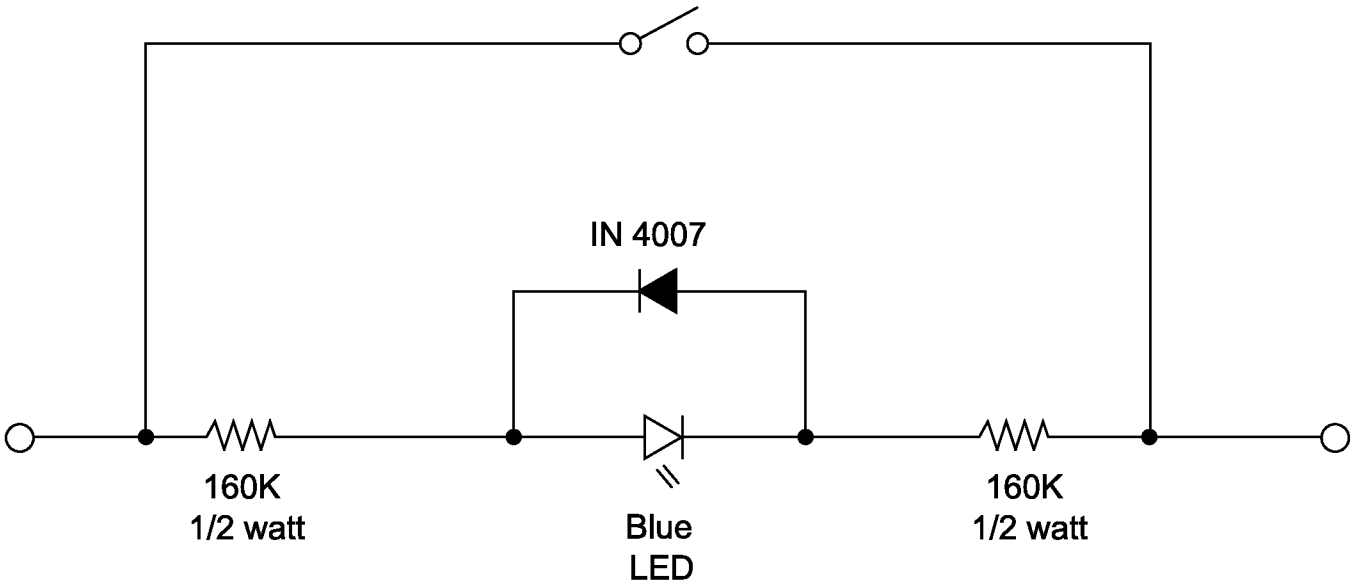
FIG. 8 is a circuit diagram of another exemplary embodiment of an illuminated switch circuit according to a sixth exemplary embodiment of the present invention.

Another preferred embodiment of the illuminated switch circuit is depicted in FIG. 8. The illuminated switch circuit of FIG. 8 includes a 160 kΩ resistor in series with a blue LED. The blue LED is connected in parallel with a 1N4007 diode, and the LED and diode are further connected in series with a second 160 kΩ resistor.

What is claimed is:

1. A low current illuminated switch circuit comprising:

a switch connected between a first terminal connectable to a source of AC power and a second terminal connectable to a ballast circuit for selectively turning on a lamp; and an LED circuit connected in parallel to the switch, the LED circuit including an LED connected in parallel with a diode such that an anode of the LED is connected to a cathode of the diode and a cathode of the LED is connected to an anode of the diode forming a parallel combination of the LED and the diode, when the switch is open current is permitted to flow in a first direction through the LED but not through the diode and in a second direction through the diode but not through the LED.

2. The low current illuminated switch circuit of claim 1, wherein the LED circuit further comprises a first current limiting resistor connected in series with the parallel combination of the LED and the diode.

3. The low current illuminated switch circuit of claim 2, wherein the LED circuit further comprises a second current limiting resistor in series with the first current limiting resistor and the parallel combination of the LED and the diode.

4. The low current illuminated switch circuit of claim 2, wherein the LED circuit further comprises a capacitor in series with the first current limiting resistor and the parallel combination of the LED and the diode.

5. The low current illuminated switch circuit of claim 1, wherein the second terminal is connected to the ballast circuit having a capacitor connected across hot and neutral wires of the AC power source.

6. The low current illuminated switch circuit of claim 1, wherein the second terminal is connected to the ballast circuit having an inductor connected between a hot wire of the AC power source and a DC current transformer.

7. The low current illuminated switch circuit of claim 6, wherein the DC current transformer comprises a rectifier and a capacitor; and the DC current transformer supplies DC power to a high frequency, high voltage amplifier circuit that drives the lamp.

8. The low current illuminated switch circuit of claim 7, wherein the lamp is a compact fluorescent lamp.

9. A method of manufacturing a low current illuminated switch circuit comprising the steps of:

connecting an LED in parallel with a diode forming a parallel combination such that an anode of the LED is connected to a cathode of the diode, and a cathode of the LED is connected to an anode of the diode to form an LED circuit;

connecting the LED circuit in parallel with a switch to form a combination switch and LED circuit, such that when the switch is closed current flows through switch, and when the switch is open current is permitted to flow in a first direction through the LED but not through the diode and to flow in a second direction through the diode by not through the LED.

10. The method of claim 9, further comprising the steps of:

connecting the combination switch and LED circuit to a first terminal on a first side of the switch, the first terminal being connectable to a source of AC power; and connecting the combination switch and LED circuit to a second terminal on a second side of the switch, the second terminal being connectable to a ballast circuit.

11. The method of claim 9, further comprising the step of: connecting a first current limiting resistor in series with the parallel combination of the LED and the diode.

12. The method of claim 11, further comprising the step of: connecting a second current limiting resistor in series with the first current limiting resistor and the parallel combination of the LED and the diode.

13. The method of claim 11, further comprising the step of: connecting a capacitor in series with the first current limiting resistor and the parallel combination of the LED and the diode.

14. The method of claim 10, further comprising the step of: connecting the second terminal to a ballast circuit that comprises a capacitor connected across hot and neutral wires of an AC power source.

15. The method of claim 14, wherein the ballast circuit further comprises an inductor connected between the hot wire of the AC power source and a DC current transformer.

16. The method of claim 15, wherein the DC current transformer comprises a rectifier and a capacitor, and the DC current transformer supplies DC power to a high frequency, high voltage amplifier circuit that drives a lamp.

17. The method of claim 16, wherein the lamp is a compact fluorescent lamp.

* * * * *